US005975706A

United States Patent [19]

Nakayama

[11] Patent Number: 5,975,706

[45] Date of Patent: Nov. 2, 1999

[54] WIDE INCIDENT ANGLE REFLECTIVE PLATE

[75] Inventor: Naoki Nakayama, Tendo, Japan

[73] Assignee: 3M Innovative Properties Company, St. Paul, Minn.

[21] Appl. No.: 09/050,813

[22] Filed: Mar. 30, 1998

[30] Foreign Application Priority Data

Mar. 31, 1997 [JP] Japan ..... 9-079772

[51] Int. Cl.[6] ..... G02B 5/24; G02B 5/128

[52] U.S. Cl. ..... 359/530; 359/529; 359/536; 359/541

[58] Field of Search ..... 359/529–542, 359/900; 404/12, 14, 16

[56] References Cited

U.S. PATENT DOCUMENTS

| | | | |
|---|---|---|---|
| 4,069,281 | 1/1978 | Eigenmann | 264/1 |
| 4,388,359 | 6/1983 | Ethen et al. | 428/143 |
| 4,605,461 | 8/1986 | Ogi | 156/233 |
| 4,712,867 | 12/1987 | Malek . | |
| 4,988,555 | 1/1991 | Hedblom | 359/538 |
| 5,557,461 | 9/1996 | Wyckoff | 359/551 |
| 5,777,791 | 7/1998 | Hedblom | 359/536 |

FOREIGN PATENT DOCUMENTS

| | | | |
|---|---|---|---|
| 0 373 826 | 6/1990 | European Pat. Off. | E01F 9/08 |
| 0 381 886 | 8/1990 | European Pat. Off. | E01F 9/08 |
| 0 683 270 | 11/1995 | European Pat. Off. | E01F 9/04 |
| 53-46363 | 4/1978 | Japan | B29C 11/00 |
| 53-46371 | 4/1978 | Japan | B29D 27/00 |
| 55-65524 | 5/1980 | Japan | B29D 27/00 |
| 57-10102 | 1/1982 | Japan | G02B 5/128 |
| 57-193352 | 11/1982 | Japan | B32B 5/30 |
| 58-208041 | 12/1983 | Japan | B32B 17/06 |
| 62-41804 | 10/1987 | Japan | B32B 33/00 |
| 7-84726 | 9/1995 | Japan | E01F 9/04 |
| 2 251 091 | 6/1992 | United Kingdom | G02B 5/128 |
| 2 267 865 | 12/1993 | United Kingdom | G02B 5/128 |
| WO 91/19857 | 12/1991 | WIPO | E01F 9/08 |
| WO 97/01677 | 1/1997 | WIPO | E01F 9/04 |
| WO 97/01678 | 1/1997 | WIPO | E01F 9/04 |

*Primary Examiner*—James Phan
*Attorney, Agent, or Firm*—Peter L. Olson

[57] ABSTRACT

A reflective plate (10) is disclosed, comprising a substrate (1), a retroreflective sheet (2) adhered to the surface of said substrate and having substantially flat base portions (3) covered with said retroreflective sheet (2), the retroreflective sheeting having retroreflective elements and a light transmissive cover layer; and a plurality of projections (4) covered with said retroreflective sheet and present on the corners of regular polygons that are arranged to form a regularly repeated pattern, wherein the arrangement of the projections (4) satisfies the relationship $0.05<h/P<0.60$.

4 Claims, 4 Drawing Sheets

(unit: mm)

(unit: mm)

WIDE INCIDENT ANGLE REFLECTIVE PLATE

TECHNICAL FIELD

The present invention relates to a wide incident angle reflective plate comprising a laminate of a substrate and a retroreflective sheet adhered to the surface of the substrate, which plate is used for improving visibility at night.

BACKGROUND OF THE INVENTION

Structures and production methods of retroreflective articles such as retroreflective sheets comprising a plurality of reflecting beads which are fixed in the support layer having a raised surface are disclosed in several publications. JP-A-55-65524 and JP-A-57-193352 disclose methods including the steps of applying a foaming component to a flat substrate surface in a spot form, and coating a resin over the substrate surface to make a support layer. On the support layer, transparent glass beads are scattered, and then the paint for the support layer is dried and cured to fix the glass beads to the support layer. Finally, the substrate is heated to blow the foaming component to produce projections.

Publications JP-A-53-46363 and JP-A-5346371 disclose methods including embossing a substrate made of thermoplastic resins to make a raised surface, and coating a paint containing resins in a thickness sufficient for filling indented portions to obtain a support layer having a flat surface. Transparent glass beads are embedded in the surface of the support layer, and then the resin in the support layer is cured to fix the glass beads in the layer. Finally, the whole sheet is heated so that the surface of substrate is recovered from the flat state to form raised surface having varying heights corresponding to the difference of coated thicknesses of the substrate resins.

Publication JP-A-57-10102 discloses a method including coating a paint which shrinks and forms wrinkles upon drying on a substrate, scattering glass beads over the wet paint, and then heating and drying the paint to form projections to which the glass beads are fixed.

Publications U.S. Pat. No. 4,069,281 and JP-A-58-237243 disclose retroreflective sheets that are produced by making projections of a paint containing resins on a substrate, embedding glass beads in the projections before drying and curing the projections, and then curing the projections to fix the glass beads.

U.K. Patent 2,251,091 discloses a retroreflective sheet produced by adhering transparent glass beads to an aluminum layer which has a plurality of indentations.

Publications JP-A-58-208041 and JP-B-7-84726 describe methods for producing the retroreflective sheets including the steps of forming a support layer from a thermoplastic polymer, and embedding parts of transparent glass beads in the surface of the support layer. Then, the support layer is embossed from the side on which the beads have been embedded, and the projections in which the parts of beads are embedded, and also the depressions in which the beads are entirely embedded.

The methods and structures described in the foregoing references do not use any light-transmitting covering layer which covers the surfaces of the beads.

Publication JP-Y-62-41804 discloses a reflective sheet having projections which are intended to prevent sticking bills thereto. This reflective sheet is produced, for example, by adhering a retroreflective sheet having a light-transmitting covering layer which covers the surfaces of beads to the surface of a substrate and embossing the substrate from its back face to form projections on the surface of the substrate. However, in general, the size of the projections which are formed to prevent sticking bills is relatively small, for example, a width of 2 mm and a height of 1 mm. Furthermore, this utility model publication does not teach any favorable reflective characteristics for incident light in a wide incident angle from a low incident angle (a direction close to the normal line to the reflective plate) to a high incident angle (a direction close to the reflective plate), that is, sizes and arrangement of the projections for a reflective sheet having good wide incident angle reflective characteristics.

Publications WO97/01677 and WO97/01678 disclose retroreflective materials comprising reflective wall-form raised portions and flat areas which are covered with an enclosed lens type retroreflective sheet, although they are not produced by embossing. However, these publications do not suggest the improvement for easily removing water droplets and solid foreign substances adhered to the flat areas.

In view of the relative disadvantages of the methods and structures described above, it is important for reflective projections to have predetermined sizes and patterns for the formation of a plate-type reflective material with excellent wide incident angle reflective characteristics. This is particularly important for the improvement of reflective characteristics against light having a relatively high incident angle, for example, 70 degrees or higher from the normal line to the reflective surface.

The reflective plates should have properties suitable for outdoor use, when they are used as construction parts of signs used outdoors. That is, they are required to have properties that their reflective luminance hardly decreases when water droplets adhere to the reflective plates, that the foreign substances such as dust are easily removed if they adhere to the reflective plates, and that they maintain sufficient reflective luminance during use.

An object of the present invention is to provide a wide incident angle reflective plate which has both good wide incident angle reflective characteristics and outdoor use characteristics.

BRIEF DESCRIPTION OF THE DRAWINGS

The present invention is described in greater detail with reference to the appended figures, in which.

DETAILED DESCRIPTION OF THE INVENTION

Figure 1:
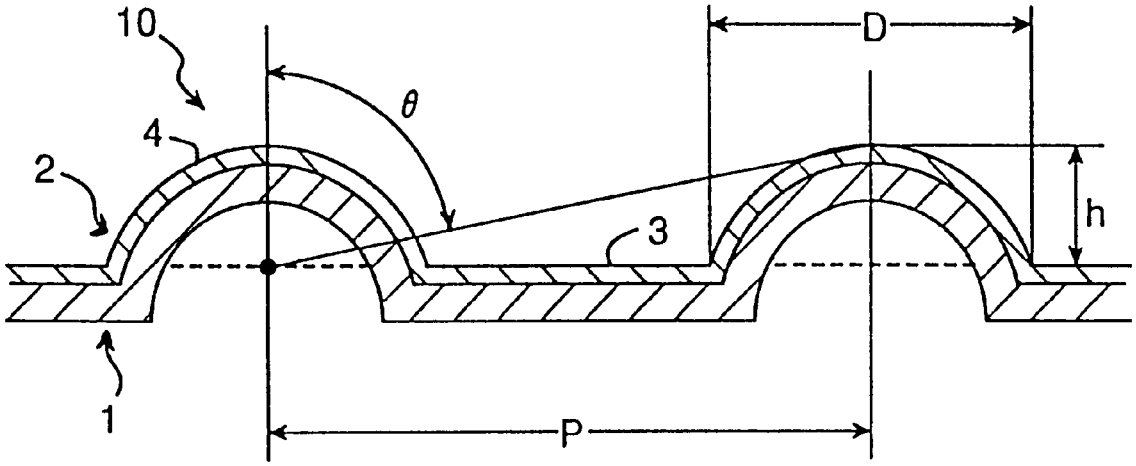
FIG. 1 is a cross section of one embodiment of the reflective plate of the present invention.

The present invention provides a wide incident angle type reflective plate (10) comprising a laminate which has a substrate (1) and a retroreflective sheet (2) adhered to the surface of the substrate and having substantially flat base portions (3) covered with the retroreflective sheet (2), and a plurality of projections (4) which are separated by the flat base portions, covered with the retroreflective sheet and present on the corners of regular polygons that are arranged to form a regularly repeated pattern. In that arrangement, the retroreflective sheet (2) comprises retroreflective elements and a light-transmitting covering layer which covers the surfaces of the retroreflective elements, and the arrangement of the projections (4) satisfies the following Equation I.

$$0.05<h/P<0.60 \qquad \text{Equation I}$$

in which P is a distance between two remotest corners of one polygon, and h is the height of the projection measured from the surface of the base portion.

The outdoor use characteristics can be improved when the retroreflective sheet (2) has the light-transmitting cover layer which covers the surfaces of the beads or cube corner retroreflective elements. The wide incident angle reflective characteristics and outdoor use characteristics are both improved when the cross sectional size and arrangement of the reflective projections (4) satisfy the above equation.

The reflective luminance in relation to the light at the relatively high incident angle can increase while increasing the density of the arranged projections in the horizontal plane when the projections are arranged on the corners of quasi-squares or quasi-equilateral triangles in the horizontal plane of the reflective plate (10). Furthermore, the reflective plate has the improved non-directionality, that is, properties for exhibiting sufficient reflective luminance against incident light from any directions in the horizontal plane. The arrangement of the projections on the corners of quasi-equilateral triangles (forming rhombuses) is particularly suitable for improving the non-directionality.

The wide incident angle reflection characteristics are improved effectively, when the vertical cross sections of the projections (4) have an arch-shaped curved surface which is upwardly convex. In addition, the deformation of the projections by external force is effectively prevented when the projections (4) are formed by embossing and have hollow spaces therein. Furthermore, the solid foreign substances are easily removed from the surface of the reflective plate. To this end, the projections preferably have shapes that their vertical cross sections include an arc or ellipsoidal arc. A solid form of such projections includes a cone with the rounded top (apex).

When the reflective plate (10) has an adhesive layer provided on the back face of the substrate (1) and a liner comprising a plastic film for protecting the adhesive layer, it is preferably produced as follows. A flat substrate made of an extensible metal or resin is provided as a substrate, a laminate is formed by applying the retroreflective sheet and an adhesive layer protected with a liner comprising a plastic film onto a surface and back face of the substrate, respectively, and the laminate is embossed by pressing an embossing tool having a plurality of projections to the laminate through the liner for forming the projections of the reflective plate.

This method can precisely and easily form the projections (4) which have the intended shapes, sizes and arrangement. The adhesive layer is easily laminated by any conventional application method such as coating prior to the formation of depressions on the back face of the substrate. The breakage of the liner during embossing can be prevented effectively when the liner comprises the plastic film.

Wide incident angle reflective plate

The wide incident angle reflective plate (sometimes referred to as "reflective plate") is a reflective plate which has a reflective luminance at a sufficient level in relation to the incident light from a direction close to the normal line to the horizontal plane of the reflective plate, and a reflective luminance at a visible level (e.g. 1.5 CPL or higher) in relation to the incident light from an inclined direction near the horizontal plane of the reflective plate, when the reflective plate is horizontally placed. In other words, the reflective plate of the present invention has the sufficient reflective properties against the incident light in the wide incident angle range, that is, the reflective luminance does not significantly decrease, for example, to 1 CPL or less, when the direction of incident light is changed from a direction near the normal line to the horizontal plane to the direction near the horizontal plane. The incident angle range in which the reflective plate of the present invention has the sufficient reflection properties is at least between 0 and 75 degrees, and between 0 and 86 degrees in a preferred embodiment. This angle is one from the normal line to the flat plane of the base portion of the reflective plate.

Equation I represents a relationship between the parameters necessary for designing the best sizes and arrangement of the projections (4). The h/P ratio in Equation I corresponds to the tangent of the angle (90−θ) in FIG. 1, that is, tan(90−θ). Accordingly, the upper and lower limits in the Equation I mean that the upper and lower limit of the angle 0 are about 60 degrees and about 87 degrees, respectively.

The angle θ is an angle (in degrees) between the line which extends from the center of one projection (4) (that is, the comer of the regular polygon forming the patterned arrangement) to the apex of the projection (4) adjacent to said one projection (that is, an intersection between the normal line to the flat plane of the base portion passing the arrangement center and the outer periphery of the protrusion), and the normal line to the base portion (3) extending from the above arrangement center (see FIG. 1). This angle θ is a measure for designing the maximum incident angle at which the sufficient reflective luminance is obtained. When the h/P ratio in the Equation I is 0.05 or less, that is, the angle θ is about 87 degrees or higher, the reflective luminance against the light having the relatively large incident angle decreases. When the h/P ratio in the Equation I is 0.60 or larger, that is, the angle θ is about 60 degrees or less, the incident angle at which the sufficient reflective luminance is obtained may not be made high enough, for example, 70 degrees or higher. The h/P ratio is preferably between 0.07 and 0.47 (θ being between about 86 and 65 degrees), in particular between 0.08 and 0.30 (θ being between about 85 and 73 degrees).

The distance P is usually 4 mm or larger. When P is less than 4 mm, the reflective properties in relation to the light at the high incident angle may not be improved. When P is too large, the arranging density of the projections decreases, and thus the effect for improving the reflective properties at the high incident angle may deteriorate. The variable P is preferably in the range between 8 and 30 mm, in particular, between 10 and 25 mm.

The height h is usually 0.5 mm or less. When h is less than 0.5 mm, the reflective properties in relation to the light at the high incident angle may not be improved. When h is too large, the retroreflective sheet may be broken during the formation of the projections. The variable h is preferably in the range between 1 and 10 mm, in particular, between 1.5 and 5 mm.

The variable D in the figures is the width of the projection between the intersections of the projection (4) and the adjacent base portions in the vertical cross section. D is usually at least 2 mm. When the size D is too small, the reflective properties in relation to the light at the high incident angle may not be improved. When D is too large, the arrangement density of the projections (which will be explained in detail) decreases, and thus the effect for improving the reflective properties at the high incident angle may deteriorate. The variable D is preferably in the range between 3 and 20 mm, in particular between 5 and 15 mm.

The arrangement of the projections (4) follows the pattern formed by regularly repeating one or more regular polygons, and the projections (4) are present on all the corners of the polygons. All the projections are discretely (independently) present, and such the arrangement of the projections makes it easy to remove the foreign substances adhered to the reflective plate. Each projection is preferably placed so that the center of gravity of the bottom figure (a horizontal cross section at the interface with the base portion), for example, a center of a circle, substantially coincides with the corner of the polygon (an arrangement center of the projection). The center of gravity of the geometrical diagram can be obtained by known mathematical methods.

The shape of the polygon is not limited as long as it satisfies Equation I. For example, the figure may be an equilateral polygon (e.g. a square, pentagon, hexagon) or a rhombus composed of two equilateral triangles which are joined at each respective side, in the horizontal plane including the base portion.

In some cases, the arranging pattern includes two or more different polygons, and thus a plurality of P values are obtained. In such the cases, all the P values preferably satisfy the Equation I for improving the high incident angle reflective characteristics.

The arrangement density of the projections depends on the above D and P values, and is usually between 5 and 150 projections per 25 $cm^2$, preferably between 10 and 80 projections per 25 $cm^2$ in the horizontal plane including the base portions. When the arrangement density of the projections is too small or too large, the reflective properties in relation to the light at the high incident angle may deteriorate. The arrangement density is the number of projections which are completely included in a square of 25 $cm^2$.

The solid shape of the projections may be a dome, dome the head of which is horizontally cut off, pyramid, truncated pyramid, cone, truncated cone, prism, cylinder, and the like. Among them, the cone (the apex of which may be rounded) is preferred because of easy embossing. The two or more projections may have the different solid shapes as long as the effects of the present invention are attained. The dome shape includes one having a quasicircular or ellipsoidal horizontal cross section.

Figure 2A:
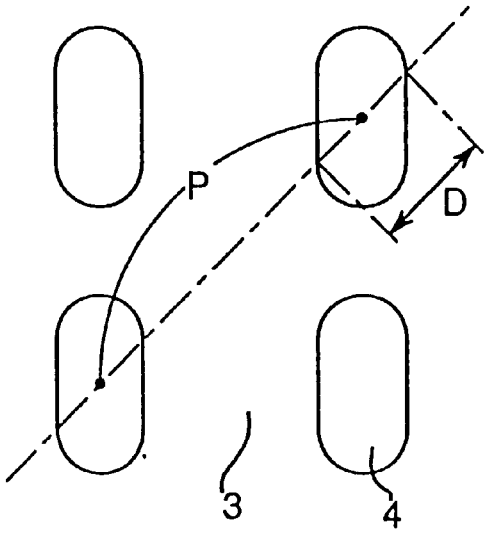
FIGS. 2A–2C show another embodiment of the arrangement of projections of the reflective plate.
Figure 2B:
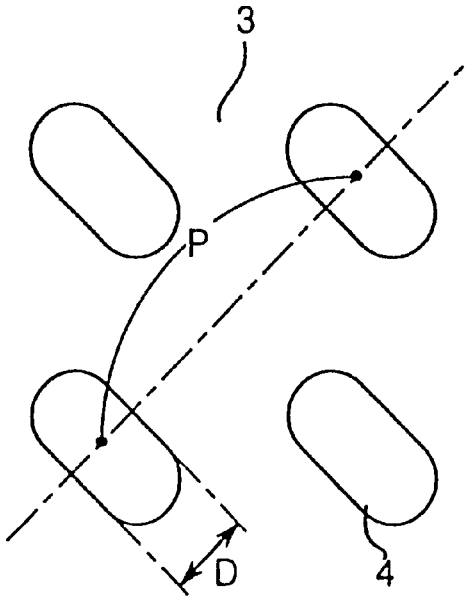
Figure 2C:
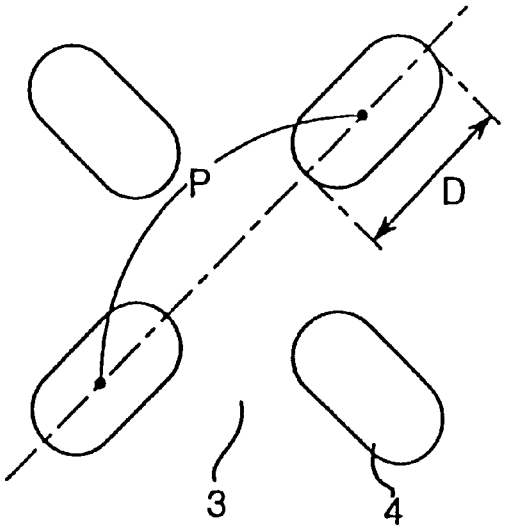

When the projections include those having the ellipsoidal horizontal cross section, they can be arranged as shown in FIGS. 2A, B and C. The arrangement of FIG. 2A is preferable for increasing the reflective luminance in relation to the light at the relatively high incident angle. In FIG. 2B, the projections are arranged so that their widest reflecting planes face the direction of the arrow, and two adjacent productions are placed most apart in this direction. Thus, the wide incident angle reflective properties are attained most effectively, when the reflective plate is illuminated by light along this direction.

The substrate is usually made of metals or plastics. Among them, soft metals or plastics with good extensibility are preferable, since they are easily embossed, and the precise projections can be easily formed. Preferable examples of the soft metals are aluminum, copper, silver, gold, and the like, and preferable examples of the soft plastics are polyethylene, polypropylene, polyvinyl chloride, polyurethane, and the like.

The thickness and tensile strength of the substrate are not limited as long as the effects of the present invention are attained. When the reflective plate is formed by embossing as explained below, the properties of the substrate are preferably selected as follows. The thickness of the substrate is preferably in the range between 0.05 and 1 mm for the metals, or in the range between 0.1 and 5 mm for the plastics. When the thickness is too small, the substrate may be broken during the formation of projections by embossing. When the thickness is too large, the formation of projections by embossing may be difficult.

The tensile strength is preferably between 1 and 10 $kg/mm^2$, more preferably between 2 and 9 $kg/mm^2$. When the tensile strength is less than 1 $kg/mm^2$, the substrate may be broken during embossing. When it exceeds 10 $kg/mm^2$, the embossing may be difficult.

Retroreflective sheet

The retroreflective sheet used in the present invention is one comprising a covering layer and reflective elements the surfaces of which are unexposed. The covering layer can be formed from an acrylic resin, polyester resin, fluororesin, polyolefin resin, polyvinyl chloride resin, and the like. The light transmission of the covering layer in the whole wavelength range is usually at least 80%.

Examples of the retroreflective sheet having the covering layer are SCOTCH LIGHT™ #580, #3810 and #1570 (all available from Minnesota Mining and Manufacturing Company of St. Paul, Minn. (3M)), and the like. These retroreflective sheets comprise the reflective element having glass beads and reflective films placed at focal points of beads, the surfaces of which beads are covered with the covering layer. The encapsulated lens type retroreflective sheet is preferable for increasing the reflective luminance. Also, reflective prisms or cube corners made of plastics are preferable as the reflective elements.

The properties of the retroreflective sheet such as elongation at break, strength at break and thickness are not limited as long as the effects of the present invention are attained. When the reflective plate is formed by embossing, these properties are preferably selected as follows. The elongation at break is preferably between 100 and 300%, more preferably between 120 and 280%. When the elongation at break exceeds 300%, the reflective plate tends to be wrinkled during embossing. When the elongation at break is less than 100%, the embossing may become difficult.

The strength at break is preferably between 1.0 and 10.0 kg/25 mm, more preferably between 3.0 and 7.0 kg/25 mm. When the strength at break is less than 1.0 kg/25 mm, the retroreflective sheet may be broken during embossing. When the strength at break exceeds 10 kg/25 mm, the embossing may become difficult. The thickness is preferably between 10 and 750 $\mu$m. When the thickness is less than 10 $\mu$m, the retroreflective sheet may be broken during embossing. When the thickness exceeds 750 $\mu$m, the embossing may become difficult.

The substrate and retroreflective sheet are adhered with any conventional adhesive such as acrylic adhesives, polyolefin adhesives, polyurethane adhesives, silicone adhesives, epoxy resin adhesives, and the like. The adhesive may be a pressure sensitive or hot melt one. The pressure sensitive adhesive is preferable, since it facilitates the production of the reflective plate by embossing due to its high flowability. The thickness of the adhesive is usually between 5 and 50 $\mu$m.

The adhesive layer formed on the back face of the substrate is used for adhering the reflective plate to an adherent such as a guardrail. The adhesive used for the adhesive layer may be the same as exemplified above. Again, the pressure sensitive adhesive is preferable, since it facilitates the embossing due to its high flowability. The thickness of the adhesive layer on the back face of the substrate is usually between 5 and 50 μm. A primer layer is preferably formed between the back face of the substrate and the adhesive layer when the substrate is made of a plastic having relatively poor adhesion properties such as polyethylene.

The liner for protecting the adhesive layer is preferably a release paper comprising a laminate of a paper sheet and a resin sheet such as polyethylene, polypropylene, and the like, and a film of a resin such as polyethylene terephthalate, polyethylene, polypropylene, and the like. These liners facilitate the embossing since they are hardly broken. In particular, a polyethylene resin film having good extensibility is preferable when the reflective plate is produced by embossing. Examples of such polyethylene resin are low and very low density polyethylene resins, ethylene-methyl methacrylate copolymers, blends of polyethylene and polypropylene, and the like.

The reflective plate of the present invention is preferably produced by embossing, since the embossing can precisely form the projections having determined shapes, sizes and arrangements. The embossing is carried out by pressing an embossing tool having projections with suitably designed shapes, sizes and arrangements to the back face of the substrate. The shapes, sizes and arrangements are designed so that they correspond to those of the projections of the reflective plate.

The pressure during the embossing is usually between 1 and 100 kg/cm$^2$, preferably between 20 and 80 kg/cm$^2$. The pressure is generated by press operations such as mechanical pressing, vacuum pressing, and the like. As the embossing tool, a pair of the first tool comprising a plate or roll having the projections on its surface and the second tool which is in contact with the surface of the retroreflective sheet is used. The second tool may be one having depressions for receiving the projections of the first tool or one having a flat surface and made of a material which deforms when the first tool is pressed from the back face of the substrate. The material for the latter second tool may be rubbers, elastomers, etc.

In the production method comprising embossing, the same conditions and embossing tools can be used, when the laminate comprising the substrate carrying, on its surface and back face, the retroreflective sheet and the adhesive layer which is protected with the liner, respectively is formed, and then, the embossing tool having a plurality of projections is pressed to the liner of the laminate for forming the projection on the laminate. The embossing may be carried out after displays such as characters, signs, etc. are printed on the surface of the covering layer of the retroreflective sheet.

Alternatively, the reflective plate of the present invention can be produced by placing the retroreflective sheet on the substrate having the already formed projections, and then press adhering the substrate and the reflective sheet under reduced pressure.

Applications of reflective plates

The reflective plate of the present invention can improve the visibility at night of materials which are illuminated by automobile head lamps at a high incident angle, for example, traffic signs, guardrails, sign boards, display plates and the like which are placed on road sides, curved areas in tunnels, etc. That is, the drivers can identify the materials to which the reflective plates are adhered from the relatively remote distances.

EXAMPLES

Example 1

A soft aluminum plate (Cat. No.: AIN30H-O available from TOYO ALUMINUM Co., Ltd.) was used as a substrate, and an enclosed lens type reflective sheet (product #580 available from 3M) was used as a retroreflective sheet. The aluminum plate had a thickness of 0.08 mm and tensile strength of about 8 kg/mm$^2$, and the retroreflective sheet had a thickness of 170 μm, elongation at break of 200%, and strength at break of 4.8 kg/25 mm. The retroreflective sheet was adhered to the substrate with an acrylic adhesive layer formed on the back face of the retroreflective sheet.

On the back face of the substrate, an acrylic adhesive layer having a thickness of about 25 μm and a protective liner made of a polyethylene resin having a thickness of 90 μm were laminated. The above formed laminate was embossed as follows to produce a reflective plate of this Example.

Figure 3:
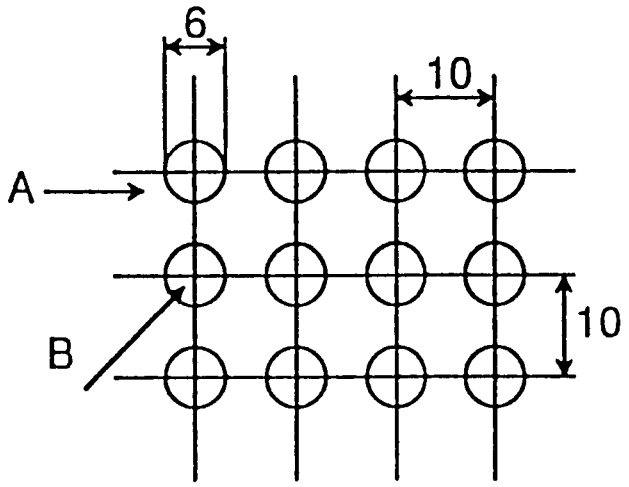
FIG. 3 shows the arrangement of projections of the reflective plate produced in Example 1.

An embossing tool having a plurality of projections was pressed on the liner on the back face of the substrate. For embossing, a pair of the first tool having projections and the second tool having depressions for receiving the projections of the first tool were used. The embossing pressure was about 70 kg/cm$^2$. Sizes and geometrical pattern of the projections are shown in FIG. 3. In this example, D was 6 mm, P was 14.1 mm and h was 2 mm. Thus, the h/P ratio in the Equation I was 0.14. The distance P was measured in the direction indicated by the arrow B (the diagonal line of the square), X is the distance between adjacent columns of projections (10 mm, in the embodiment shown), and Y is the distance between adjacent rows (10 mm, in the embodiment shown).

The reflective luminance was measured under the conditions shown in Tables 1 and 2. It was found that the reflective plate of this Example had both excellent wide incident angle reflective characteristics and outdoor use characteristics (anti-staining). The reflective luminance in Table 1 was measured with a retroreflective meter according to JIS Z 8714, while that in Table 2 was measured with MIROLUX 7 manufactured by TOSHIBA BALLOTINI.

Example 2

Figure 4:
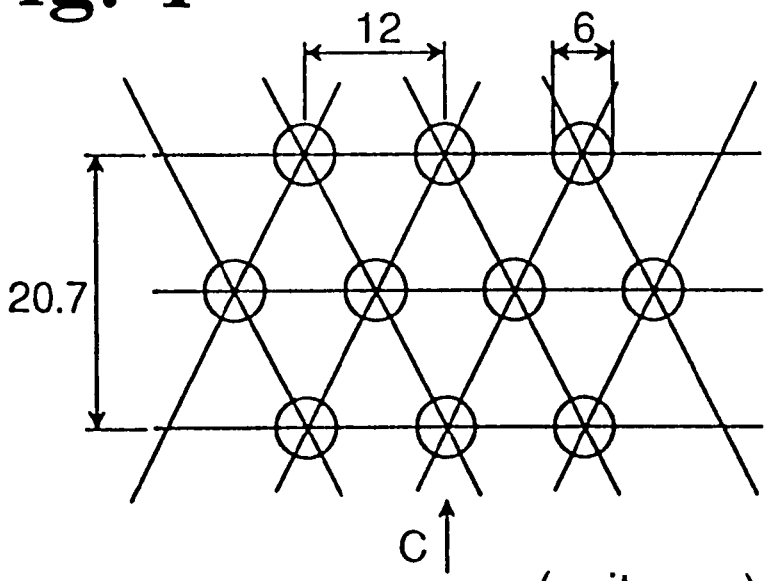
FIG. 4 shows the arrangement of projections of the reflective plate produced in Example 2.

A reflective plate was produced in the same manner as in Example 1 except that projections were arranged in the geometrical pattern shown in FIG. 4, that is, rhombuses (composed of equilateral triangles) in which D was 6 mm, P was 20.7 mm, and h was 2 mm. Thus, the h/P ratio in the Equation I was 0.10. The distance P was measured in the direction indicated by the arrow C. The distance X is between adjacent columns (12 mm, in the embodiment shown), and Y' is the distance between two rows of equal lateral spacing (20.7 mm, in the embodiment shown). The measured reflective luminances are shown in Tables 1 and 2.

Example 3

A reflective plate was produced in the same manner as in Example 2 except that the retroreflective sheet was changed to the encapsulated lens type reflective sheet (product #3870 J available from 3M). This encapsulated lens type reflective sheet had a total thickness of about 280 μm, elongation at break of 200% and strength at break of 5.9 kg/25 mm. The measured reflective luminances are shown in Tables 1 and 2.

Example 4

A reflective sheet was produced in the same manner as in Example 1 except that the sizes and arrangement of the projection were changed to D of 2.7 mm, P of 7.4 mm, h of 0.6 mm, and thus h/P of 0.08. The reflective luminance in the direction B was about 450 mcd/m$^2$ when the incident and observation angles were 86.5° and 1.5°, respectively.

Comparative Example 1

Figure 5:
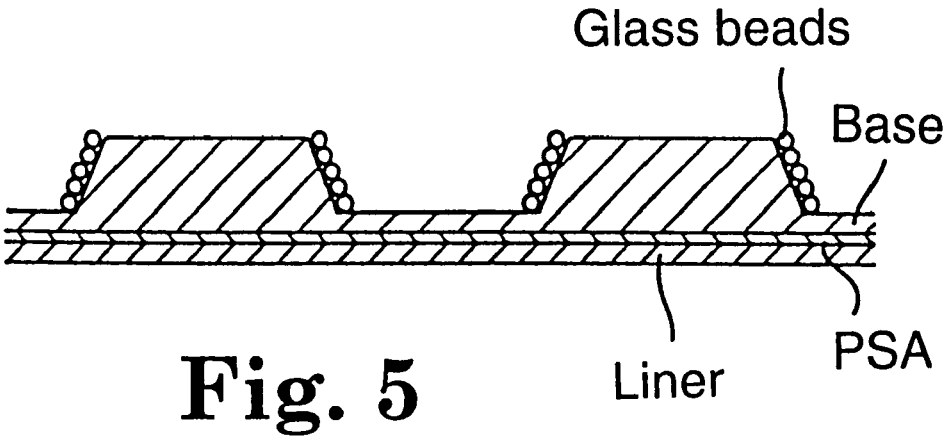
FIG. 5 is a cross section of the roadway marking material used in Comparative Example 1.

A roadway marking material #380 (available from 3M) was used, and the reflective luminance was measured in the same manner as in Example 1. This roadway marking material had the cross sectional structure of FIG. 5. The glass beads 100 were adhered to the side surfaces of the projections, which protrude above base 102. This material was an exposed lens type having no covering layer. Pressure sensitive adhesive layer 104 and liner 106 were also provided. The results are shown in Tables 1 and 2.

Comparative Example 2

Figure 6:
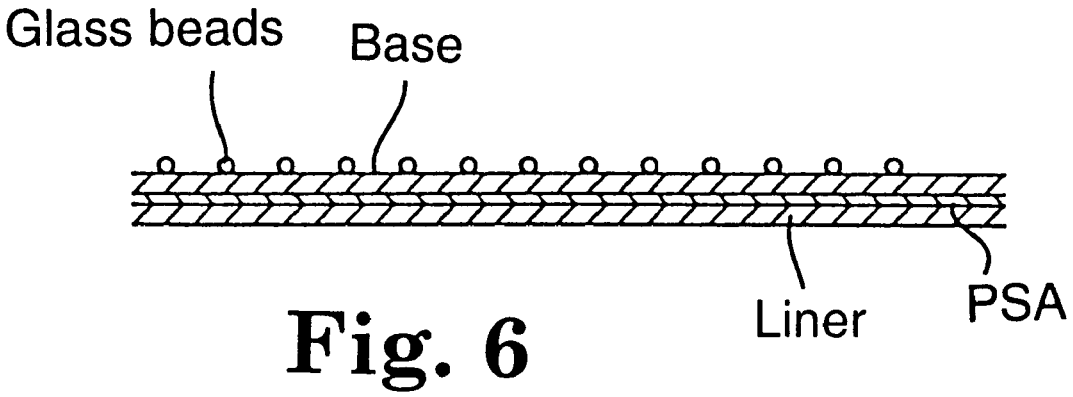
FIG. 6 is a cross section of the reflective plate used in Comparative Example 2.

SCOTCH LANE™ #6160 material, available from 3M, was used, and the reflective luminance was measured in the same manner as in Example 1. This product had the cross sectional structure having no projection, and the glass beads 100' were scattered substantially in a single layer on base 102' so that the reflective luminance in relation to the light at a relatively high incident angle can be increased, as shown in FIG. 6. This product was an exposed lens type having no covering layer over the surfaces of the beads. The results are shown in Tables 1 and 2.

Comparative Example 3

The same encapsulated lens type retroreflective sheet as used in Example 3 was used, and the reflective luminance was measured in the same manner as in Example 1. The results are shown in Tables 1 and 2.

Comparative Example 4

The same enclosed lens type reflective sheet as used in Example 1 was used as such, and the reflective luminance was measured in the same manner as in Example 1. The results are shown in Tables 1 and 2. The reflective luminance in relation to the light at the incident angle of 75 to 85° in this Comparative Example was less than one tenth of that of Example 1, since this reflective sheet had no reflective projection.

TABLE 1

Unit: CPL

| Incident angle (observation angle = 0.2°) | Example 1 Direction A | Example 1 Direction B | Example 2 Direction C | Example 3 Direction C | C. Ex. 1 | C. Ex. 2 | C. Ex. 3 | C. Ex. 4 |
|---|---|---|---|---|---|---|---|---|
| 5 | 66.9 | 67.7 | 67.7 | 197.0 | 1.45 | 25.90 | 340.0 | 120.0 |
| 15 | 60.7 | 62.3 | 62.3 | 191.6 | 1.35 | 6.90 | 332.0 | 101.0 |
| 25 | 48.2 | 52.1 | 51.4 | 176.6 | 1.24 | 5.80 | 314.0 | 67.50 |
| 35 | 32.7 | 36.6 | 35.0 | 149.5 | 1.07 | 5.40 | 263.0 | 33.70 |
| 45 | 17.9 | 21.0 | 19.4 | 102.8 | 0.87 | 4.50 | 166.0 | 11.50 |
| 55 | 8.56 | 10.1 | 9.34 | 51.4 | 0.67 | 3.40 | 62.10 | 3.06 |
| 65 | 3.11 | 4.67 | 3.89 | 20.2 | 0.50 | 2.10 | 12.20 | 0.76 |
| 75 | 1.55 | 1.55 | 1.55 | 8.56 | 0.34 | 1.07 | 0.89 | 0.10 |
| 85 | 0.30 | 0.77 | 0.30 | 2.33 | 0.19 | 0.30 | 0.04 | 0.03 |

TABLE 2

I claim:

1. A reflective plate (10) comprising:

(a) a substrate (1);

(b) a retroreflective sheet (2) adhered to the surface of said substrate and having substantially flat base portions (3) covered with said retroreflective sheet (2), the retroreflective sheeting having retroreflective elements and a light transmissive cover layer which covers the surfaces of the retroreflective elements; and (c) a plurality of projections (4) covered with said retroreflective sheet and present on the corners of regular polygons that are arranged to form a regularly repeated pattern, wherein the arrangement of the projections (4) satisfies the relationship $0.05<h/P<0.60$, in which P is the distance between two most remote corners of one polyhedron, and h is the height of the projection measured from the surface of said base portion.

2. The reflective plate of claim 1, wherein the retroreflective sheet includes microspheres.

3. A method for producing a wide incident angle reflective plate of claim 1, comprising steps of:

(a) providing a flat substrate made of an extensible metal or resin;

(b) forming a laminate by applying said retroreflective sheet and an adhesive layer onto a surface of said substrate; and (c) embossing said laminate by pressing an embossing tool having a plurality of projections to said laminate through said liner for forming said projections in the reflective plate.

4. A reflective plate (10) comprising:

(a) a substrate (1);

(b) a retroreflective sheet (2) adhered to the surface of said substrate and having substantially flat base portions (3) covered with said retroreflective sheet (2), the retroreflective sheeting having cube corner retroreflective elements that are not exposed; and (c) a plurality of projections (4) covered with said retroreflective sheet and present on the comers of regular polygons that are arranged to form a regularly repeated pattern, wherein the arrangement of the projections (4) satisfies the relationship $0.05<h/P<0.60$, in which P is the distance between two most remote corners of one polyhedron, and h is the height of the projection measured from the surface of said base portion.

* * * * *

UNITED STATES PATENT AND TRADEMARK OFFICE

CERTIFICATE OF CORRECTION

PATENT NO. : 5,975,706
DATED : November 2, 1999
INVENTOR(S) : Nakayama, Naoki

It is certified that error appears in the above-identified patent and that said Letters Patent is hereby corrected as shown below:

Column 4,
Line 26, delete "0" and insert in place thereof -- θ --.
Line 29, delete "comer" and insert in place thereof -- corner --.

Signed and Sealed this

Twenty-eighth Day of January, 2003

JAMES E. ROGAN
*Director of the United States Patent and Trademark Office*